US006315493B2

(12) United States Patent
Malone et al.

(10) Patent No.: US 6,315,493 B2
(45) Date of Patent: Nov. 13, 2001

(54) RETRIEVABLE FILTER ELEMENT FOR SUBSURFACE DRAINAGE

(75) Inventors: Philip G. Malone, Vicksburg, MS (US); Brad L Huntsman, Dayton; Brent E. Huntsman, Xenia, both of OH (US)

(73) Assignee: U.S Army Corps of Engineers as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/797,671

(22) Filed: Mar. 5, 2001

Related U.S. Application Data

(62) Division of application No. 09/408,911, filed on Sep. 30, 1999.

(51) Int. Cl.[7] ..... E02B 11/00

(52) U.S. Cl. ..... 405/45; 405/43; 405/50; 405/36; 210/747

(58) Field of Search ..... 405/45, 44, 43, 405/36, 50, 46, 157, 184.4; 210/170, 747

(56) References Cited

U.S. PATENT DOCUMENTS

| | | | | |
|---|---|---|---|---|
| 3,952,529 | * | 4/1976 | Lefever | 405/157 |
| 5,051,028 | * | 9/1991 | Houck et al. | 405/45 |
| 5,100,258 | * | 3/1992 | VanWagoner | 405/45 |
| 5,639,364 | * | 6/1997 | Houck et al. | 405/45 |
| 5,836,115 | * | 11/1998 | Clay et al. | 405/43 |
| 5,836,716 | * | 11/1998 | Johnson et al. | 405/43 |
| 5,938,372 | * | 8/1999 | Lichfield | 405/38 |

* cited by examiner

*Primary Examiner*—David Bagnell
*Assistant Examiner*—Frederick L. Lagman
(74) *Attorney, Agent, or Firm*—John Mac Evoy; Earl H Baugher, Jr.

(57) ABSTRACT

Filter elements for draining wastewater into the soil in leach fields comprise net sacks filled with scrap rubber or plastic chips and supplied with fabric filter cloth. Leach fields are constructed by excavating trenches, placing a first row of filter elements at the bottom of the trenches, installing a drain pipe on top of the row of filter elements, placing a second row of filter elements on top of the first row and the drain pipe, overlapping the pieces of filter cloth to provide a barrier to the surrounding soil, and backfilling the trench with soil.

5 Claims, 1 Drawing Sheet

RETRIEVABLE FILTER ELEMENT FOR SUBSURFACE DRAINAGE

This is a division of an application, U.S. Ser. No. 09/408,911, filed on Sep. 30, 1999.

GOVERNMENT INTEREST STATEMENT

The invention described herein may be manufactured, licensed, and used by or for governmental purposes without the payment of any royalties thereon.

BACKGROUND OF THE INVENTION

1. Field of the Invention

This invention relates to filter elements for leach fields for draining septic tank effluents, rainwater, and treated industrial and municipal wastewater into the ground by means of buried filter elements. It furthermore relates to filter elements utilizing rubber tire or plastic scrap, wastes that are finding a constructive use in the filter elements of this invention instead of taking up valuable space in landfills.

This invention also relates to a process for constructing leach fields utilizing the filter elements of this invention.

2. Prior Art

Septic tank effluents, rainwater, and treated industrial and municipal wastewater are conventionally drained into the soil through slotted or perforated drain pipes into trenches filled with gravel and then backfilled with soil. The gravel facilitates the drainage of water into the soil and delays the plugging of the slots or perforations in the drain pipes by soil particles. However, the slots or perforations in the drain pipes and the gravel beds eventually do become plugged with fine solids leached from the soil, making the leach fields ineffective and requiring the removal of the drain pipes and gravel and the construction of new leach fields.

SUMMARY OF THE INVENTION

The filter elements of this invention are assembled by placing rubber or plastic scrap pieces in net sacks. The rubber and plastic scrap pieces, herein referred to as aggregate, typically, are in the form of chips. Used automobile and truck tires are the principal source of rubber scrap. The net sacks have openings that are smaller than the aggregate chips such that they cannot fall out of the net sacks through these openings when installed. The net sacks containing the aggregate are attached to pieces of fabric filter cloth, which may be wrapped around the net sacks or draped around adjacent filter elements so that the soil surrounding the net sacks cannot infiltrate into the enclosed aggregate chips, but water draining into the aggregate chips can escape through the filter cloth into the surrounding soil. The net sacks filled with the aggregate and wrapped in filter cloth constitute the filter elements of this invention.

In the construction of a leach field, the filter elements are placed in trenches so as completely to surround the perforated or slotted drain pipes that convey the wastewater effluents into the leach field. Every portion of the drain pipes is surrounded by at least two filter elements to ensure that all the wastewater passes through the aggregate The trenches are then backfilled with soil. Fine soil particles cannot enter and plug the filter elements because the pores of the filter cloth are smaller than the soil particles.

This invention also relates to a process for constructing leach fields utilizing the filter elements of this invention.

DETAILED DESCRIPTION OF THE INVENTION

Figure 1:
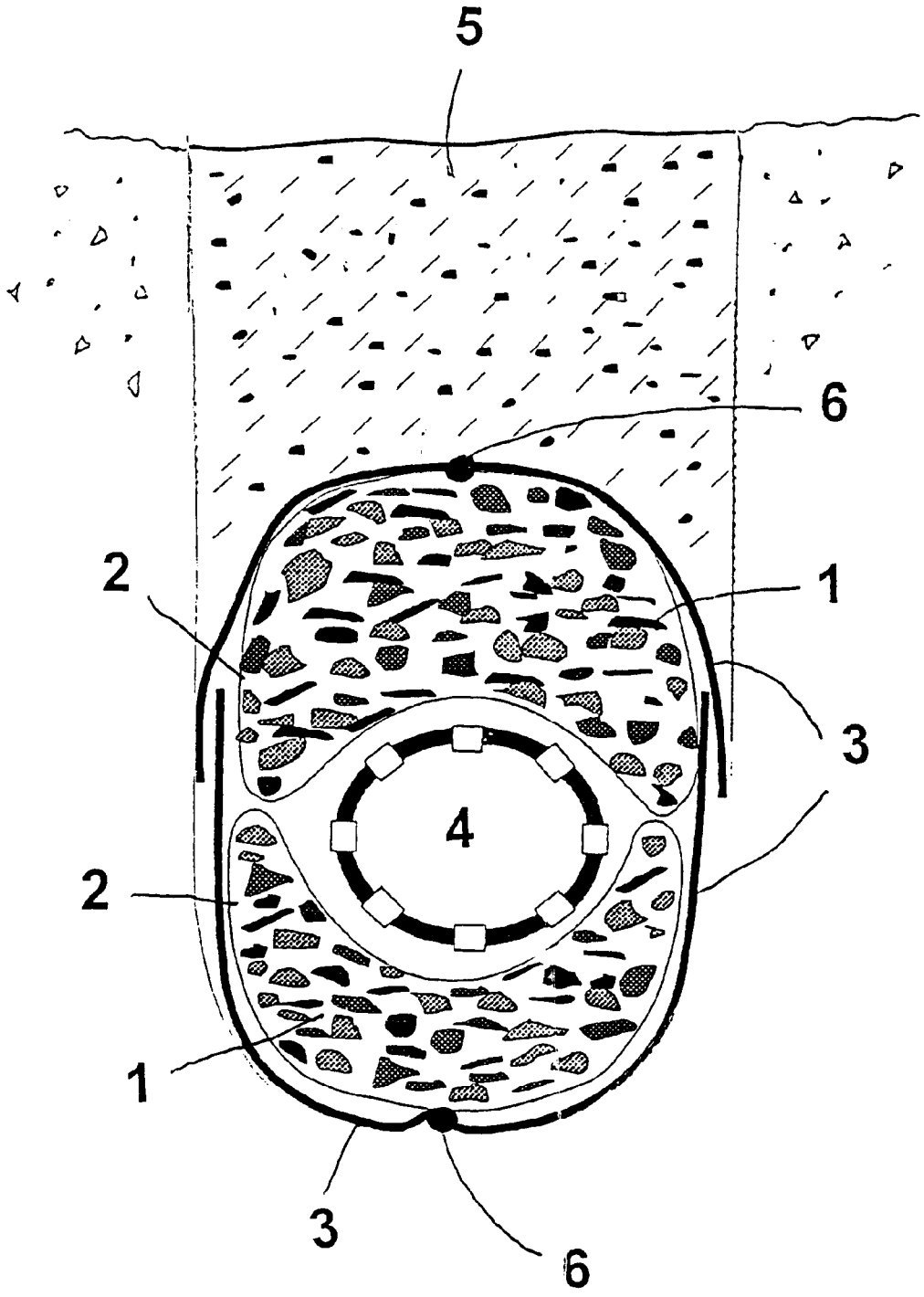
FIG. 1 is a cross-sectional view of the filter elements of this invention as installed in a drainage trench and covered with soil.

With reference to FIG. 1, the filter elements of this invention consist of three parts: aggregate 1, net sacks 2 holding the aggregate, and filter cloth 3. They are assembled by placing rubber or plastic scrap pieces, herein referred to as aggregate 1, in net sacks 2. Used automobile and truck tires are the principal source of rubber scrap. The aggregate pieces, typically, are in the form of chips. The net sacks have openings that are smaller than the aggregate chips such that they cannot fall out of the net sacks through these openings.

The net sacks containing the aggregate preferably are furnished with an attached section of fabric filter cloth. When being installed around the drainage pipe in the trench, the net sacks with aggregate are placed against the perforated pipe, and the filter cloth on each net sack is made to overlap with that of an adjacent element to form a barrier preventing infiltration of fine soil particles into the aggregate. Optionally, the net sacks with aggregate may be wrapped individually with filter cloth. The net sacks filled with the aggregate and wrapped in filter cloth in any manner whatever, constitute the filter elements of this invention.

In the construction of a leach field, the filter elements are placed in trenches so as completely to surround the slotted or perforated drain pipes 4 that convey the wastewater effluents into the leach field. The net sacks are placed directly against the drain pipe and the filter cloth is draped against the surface of the surrounding soil. A row of filter elements is placed on the bottom of each trench, the drain pipe is installed to rest on this row of filter elements, a second row of filter elements is placed on top of the lower row of filter elements and the drain pipe 4, and the trench is backfilled with soil 5. The upper and lower pieces of filter cloth are allowed to drape over one another. Optionally, each net bag with aggregate may be wrapped individually in filter cloth. The object is to create a barrier with the filter cloth preventing fine soil particles from entering and plugging the filter elements because the pores of the filter cloth are smaller than the soil particles.

The rubber scrap pieces are typically in the form of chips about ¾" to 2" long and wide by about ¼" to ¾" thick. Plastic scrap pieces also range from ¾" to 2" in diameter. The openings in the net sacks are about ¼" to ½" across. Aggregate pieces thus cannot fall out through these openings once placed in the net sacks.

The net sacks filled with aggregate are wrapped in pieces of filter cloth having small pore sizes (<1/16"). These prevent fine soil particles from being washed into the net sacks and plugging the void spaces between the aggregate pieces. The filter fabric may optionally be connected to the net sack at 6 by metal wires, preferably iron wires, which help locate the trenches of the leach fields with metal detectors once they are buried. Also, pieces of brightly colored plastic tape may be attached to the filter elements to help locate the elements when a trench is reopened to service the leach field.

The net sacks preferably have a volume of 2 to 2.5 cubic feet. The bulk density of the aggregate ranges from 25 to 30 lbs. per cubic foot. The weight of a filter element thus ranges from about 50 to about 75 lbs. Filter elements thus may be preassembled at a convenient off-site location, shipped to the jobsite, and installed.

The net sacks and the filter cloths used in the construction of the filter elements of this invention are made of polymeric materials such as polyester (e.g., polyethylene glycol terephthalate), polypropylene, polyethylene, polyamide (e.g., nylon), and polyvinyl chloride. For the net sacks, polyester and nylon are preferred. For the filter cloth, spun-woven or heat-bonded polypropylene is preferred.

While this invention has been described in terms of a specific embodiment, it is understood that it is capable of further modification and adaptation of the invention following in general the principle of the invention and including such departures from the present disclosure as come within the known and customary practice in the art to which the invention pertains and may be applied to the central features set forth, and fall within the scope of the invention and of the limits of the appended claims.

What we claim is:

1. A process for constructing a leach field having a drainage trench, the process comprising the steps of:

placing a first row of sheets of filter cloth at a bottom of the trench;

placing a first row of filter elements on the first row of sheets of filter cloth at the bottom of the trench;

installing a drain pipe on top of the first row of filter elements, such that the drain pipe is in contact with the first row of filter elements;

placing a second row of filter elements on top of the first row of filter elements and the drain pipe;

placing a second row of sheets of filter cloth on top of the second row of filter elements, the second row of sheets of filter cloth having free edges on opposite sides thereof overlapping free edges on opposite sides of the first row of sheets of filter cloth; and backfilling the trench with soil.

2. The process of claim 1 further comprising the step of securing said filter cloth to the filter element.

3. The process of claim 1 wherein the filter element is a net sack having openings of predetermined size, filled with aggregate having dimensions greater than openings of the net sack.

4. A process for draining wastewater into a trench of a leach field comprising the steps of:

placing in the bottom of said trench a first row of net sacks, filled with aggregate and individually wrapped with filter cloth;

installing a drain pipe on top of said row of wrapped net sacks, in a manner such that said pipe is in direct contact with said net sack;

placing a second row of said individually wrapped net sacks filled with aggregate on top of said first row of wrapped net sacks and said pipe such that the drain pipe is in direct contact with said second net sacks; and backfilling the trench with soil.

5. The process of claim 4 wherein said net sacks have openings of predetermined size, and said aggregate have dimensions greater than openings of the net sacks.

* * * * *